United States Patent [19]

Segal et al.

[11] Patent Number: 4,896,687

[45] Date of Patent: Jan. 30, 1990

[54] COLLAPSIBLE CANE

[75] Inventors: Barry M. Segal; Charles Foxman, both of St. Louis, Mo.

[73] Assignee: Americane, Inc., Maryland Heights, Mo.

[21] Appl. No.: 264,863

[22] Filed: Oct. 31, 1988

[51] Int. Cl.[4] ..... A45B 9/00

[52] U.S. Cl. ..... 135/75; 135/108; 403/109; 403/104

[58] Field of Search ..... 135/75, 108; 403/109, 403/104

[56] References Cited

U.S. PATENT DOCUMENTS

| | | | |
|---|---|---|---|
| 2,298,140 | 10/1942 | Maee | 403/109 |
| 2,456,205 | 12/1948 | Magder | 403/104 |
| 2,587,511 | 2/1952 | Nerman | 403/104 |
| 2,599,222 | 6/1952 | Bergquist | 403/109 |
| 3,456,662 | 7/1969 | Weber | 135/15 |
| 3,515,418 | 6/1970 | Nielsen | 403/109 |
| 3,987,807 | 10/1976 | Varnell | 135/66 |
| 4,073,456 | 2/1978 | Karapita | 403/104 |
| 4,238,164 | 12/1980 | Mazzolla | 403/109 |
| 4,448,442 | 5/1984 | Henning | 135/75 |
| 4,508,467 | 4/1985 | Choffin | 403/104 |

FOREIGN PATENT DOCUMENTS

| | | | |
|---|---|---|---|
| 1251092 | 9/1967 | Fed. Rep. of Germany | 403/109 |
| 2319059 | 10/1974 | Fed. Rep. of Germany | 403/109 |

*Primary Examiner*—Henry E. Raduazo

*Attorney, Agent, or Firm*—Polster, Polster and Lucchesi

[57] ABSTRACT

A collapsible cane having a series of interfitting smaller and larger telescoping sections which are interlocked against collapse, when extended, is disclosed. The smaller interfitting telescoping section includes an internal expansion device activated by relative rotary movement between adjacent larger and smaller interfitting telescoping sections for engagement with an inner wall of the larger interfitting telescoping section. The internal expansion device operates against a circumferential depression provided in the larger interfitting telescoping sections enabling the internal expansion device to expand against the internal wall of the larger interfitting telescoping section. At least one of the larger telescoping interfitting sections also includes a second circumferential depression immediately adjacent an outer free end thereof for slidable engagement with an outer wall of an adjacent smaller telescoping interfitting section to provide guiding and centering action between said adjacent interfitting smaller and larger telescoping sections during extension and collapse thereof. In conjunction therewith, the internal expansion device includes an improved positive locking action to positively secure the extended interfitting telescoping sections. To prevent unintended collapse of the telescoping sections, as a result of wear or the like, the second circumferential depression is positioned for engaging the internal expansion device to maintain operative engagement with the internal wall of the larger interfitting telescoping section, in the event of failure of the first circumferential depression worn down by continued used thereof.

17 Claims, 2 Drawing Sheets

FIG. 1.
FIG. 3.
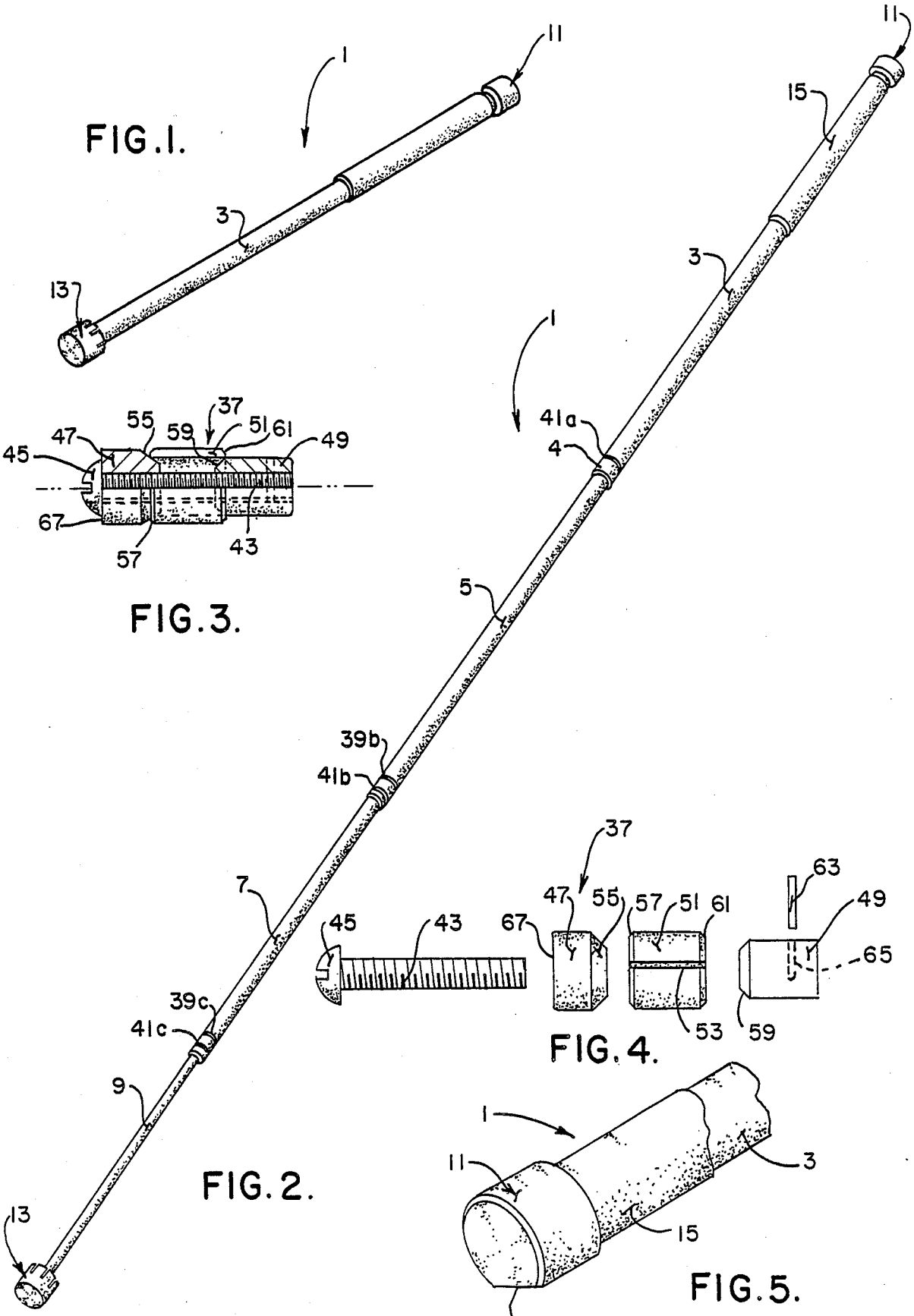
FIG. 2.
FIG. 4.
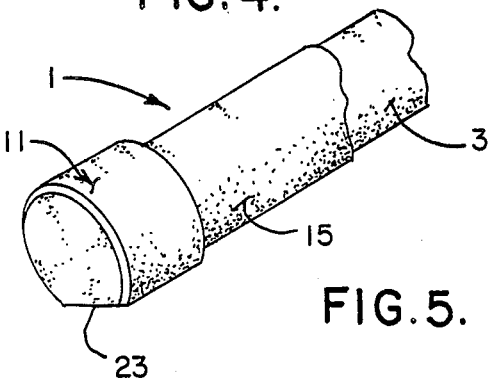
FIG. 5.

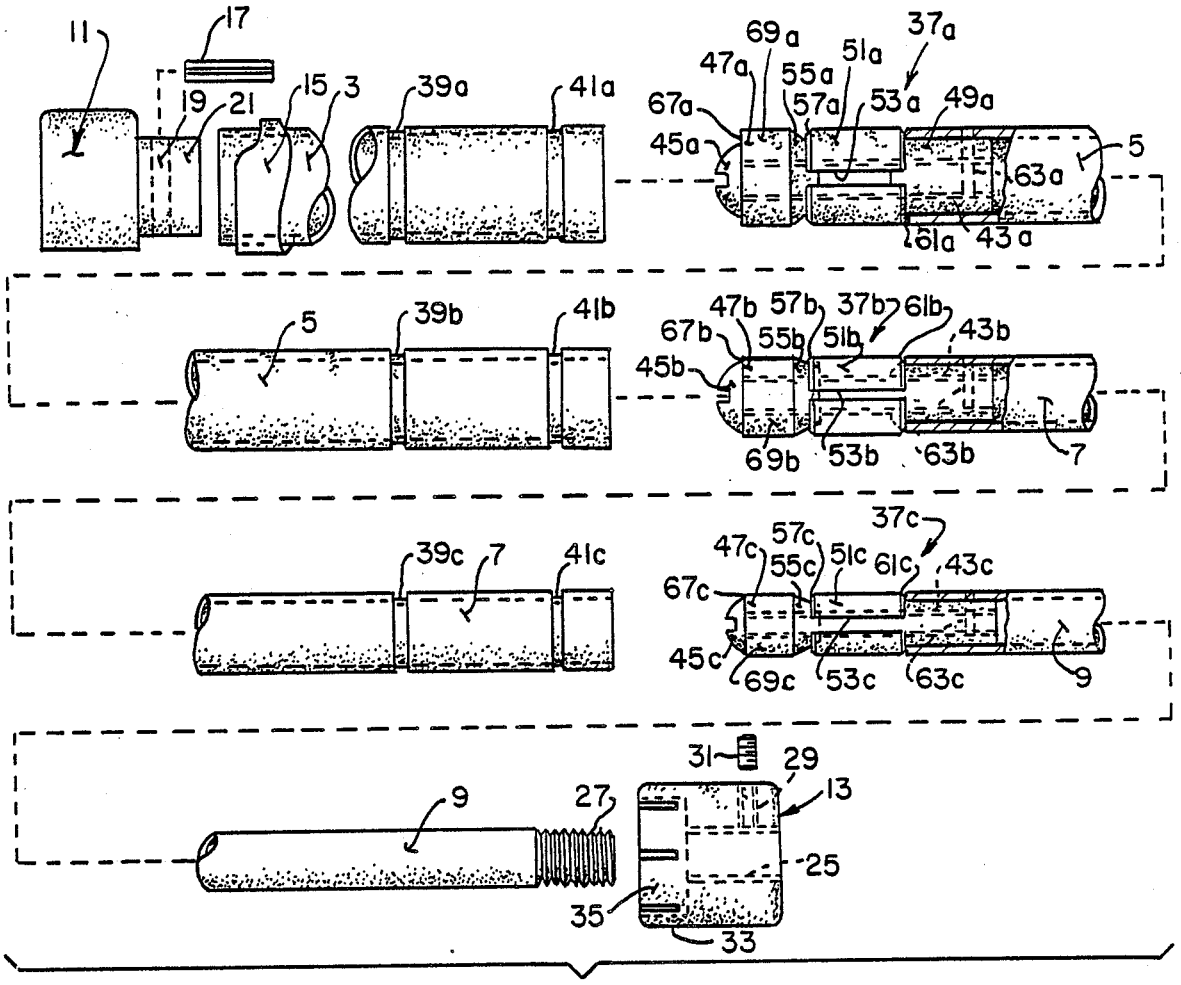
FIG. 6.
FIG. 7.
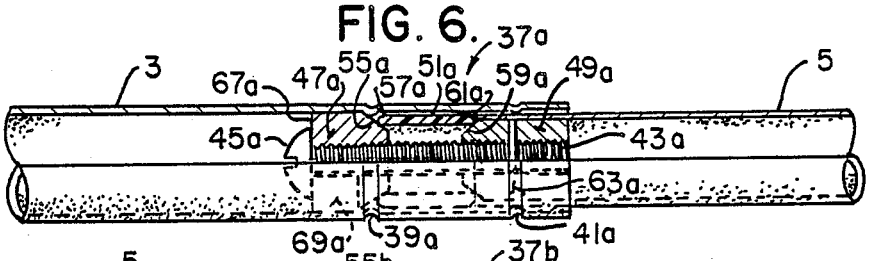
FIG. 8.
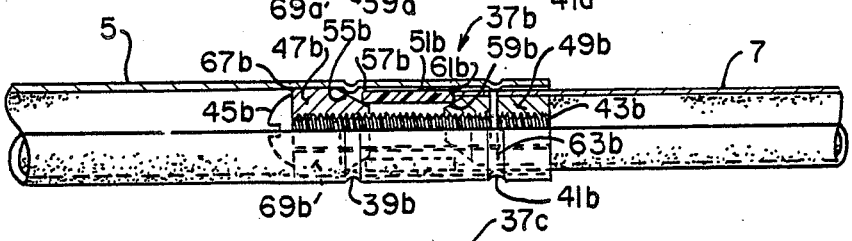
FIG. 9.
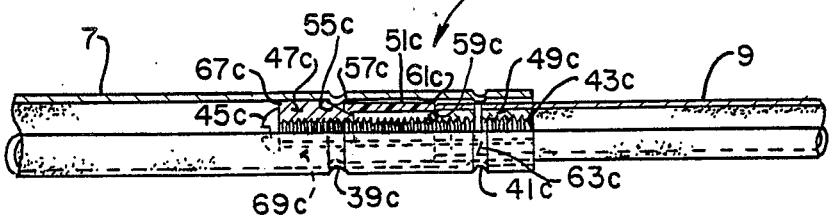

COLLAPSIBLE CANE

CROSS REFERENCE TO RELATED PATENT APPLICATIONS

This application is an improvement over certain of the features disclosed in prior co-pending application entitled COLLAPSIBLE CANE, bearing Ser. No. 200,055 filed Apr. 26, 1988. Both the aforementioned co-pending application and this application are owned by a common assignee.

BACKGROUND OF THE INVENTION

The present invention relates to an improved collapsible cane for use by handicapped people, in which the collapsible cane includes interfitting telescoping sections which are interlocked against collapse when extended.

As explained in the aforementioned co-pending patent application, walking canes have been used for many hundreds of years to assist handicapped people during walking. Generally speaking, most prior art walking canes are made from one-piece wood or metal to provide a strong supporting structure that has long life.

Blind handicapped persons desire a strong and reliable walking cane during use, which is also "not in the way" during non-use. One way in which these canes can be hidden or kept out of the way is to provide a collapsible type cane. Of course, several different types of collapsible canes have been developed, such as those identified in the prior related co-pending application. However, most of these prior art collapsible canes are not capable of both being strong and durable in use, while also being quickly and conveniently collapsed when not in use.

The collapsible cane of the prior related co-pending application includes a series of interfitting telescoping sections which are interlocked together when collapsed and interlocked against collapse when extended. The collapsible cane includes first interlocking means for externally interlocking the interfitting telescoping sections together as a unit, when collapsed. The first interlocking means is also capable of being released to permit longitudinal extension of the interfitting telescoping sections. The collapsible cane is further provided with second interlocking means for internally interlocking adjacent telescoping sections together against collapse, when activated. When the second interlocking means is de-activated, the telescoping interfitting sections may be telescoped with respect to one another for subsequent re-engagement with the first interlocking means. In some cane designs, the interfitting telescoping sections may be solely provided with internal expansion means for engagement with an inner wall of adjacent telescoping sections, when activated, to interlock adjacent telescoping sections together against collapse, and when de-activated, permitting collapse and telescopic interfitting assembly of adjacent interfitting telescoping sections relative to one another. Preferably, axial interlocking means are used for holding the interfitting telescoping sections together as a unit, when collapsed, with rotary interlocking means being used for interlocking adjacent telescoping sections against collapse, when extended.

While the aforementioned collapsible cane in the prior co-pending related patent application has worked better than all other collapsible canes, for the reasons set forth in such prior co-pending related application, there are several areas of improvement identified in this patent application which enhance the effectiveness and operation of the collapsible cane, as will be discussed in detail below.

SUMMARY OF THE INVENTION

Among the several objects and advantages of the present invention may be noted:

the provision of a collapsible cane as disclosed in the prior related co-pending application, which retains all of the advantages of such collapsible cane with improved operating features as disclosed herein;

the provision of the aforemention collapsible cane which provides improved guiding and centering action between adjacent interfitting telescoping sections during extension and collapse thereof;

the provision of the aforementioned collapsible cane which provides positive locking action between the extended adjacent interfitting telescoping sections;

the provision of the aforementioned collapsible cane which provides improved safety between operating components, to maintain the components in operative engagement, in the event of failure due to worn parts;

the provision of the aforementioned collapsible cane which provides faster, more economical and better engagement of the operative components during assembly thereof; and the provision of the aforementioned collapsible cane which includes an improved handle knob to keep the cane from rolling.

Briefly stated, the improved collapsible cane of the present invention has a series of interfitting smaller and larger telescoping sections which are interlocked against collapse when extended. Each of the smaller interfitting telescoping sections include internal expansion means activated by relative rotary movement between adjacent larger and smaller interfitting telescoping section for engagement with an inner wall of the larger interfitting telescoping section. Each larger interfitting section includes circumferential depression means against which the internal expansion means operates to expand against an internal wall of the larger interfitting telescoping section during the relative rotary movement between said sections, at least one of said larger telescoping sections also including a second circumferential depression means longitudinally spaced from said first circumferential depression means and positioned immediately adjacent an outer free end of each said larger interfitting telescoping section. Each said second circumferential depression means in at least one of the larger telescoping sections being slidably engageable by an outer wall of an adjacent smaller telescoping interfitting section to provide guiding and centering action between said adjacent interfitting smaller and larger telescoping sections during extension and collapse thereof.

The second circumferential depression means is also positioned for engagement with the internal expansion means to maintain operative engagement with the internal wall of the larger interfitting telescoping section, in the event of failure of the first circumferential depression means being worn down by continued use thereof.

The interfitting telescoping sections comprise a series of progressively smaller telescoping sections enabling relative telescoping assembly of adjacent telescoping sections within each other, with all of the telescoping sections being captured within the largest telescoping section when all of the interfitting telescoping sections are longitudinally collapsed relative to one another. All but the largest and smallest of the interfitting telescoping sections preferably include both the longitudinally spaced first and second circumferential depression means.

Each internal expansion means associated with the smaller interfitting telescoping section includes wedge elements for engaging and expanding an associated intermediate locking cylinder against an internal wall of an adjacent larger interfitting telescoping section. Wedge elements are threadably engaged by a common threaded member on opposite sides of the locking cylinder, with the common threaded member having an enlarged head for engaging a transverse end surface of one of the wedge elements, and the other wedge element being pinned to the common threaded member and to the smaller interfitting telescoping section.

External gripping means for gripping the largest interfitting telescoping section of the collapsible cane, when all of the interfitting telescoping sections are telescoped therein and for also interlocking the interfitting telescoping sections together as a unit, may be provided. The external gripping means may include a cane tip mounted at an outer most free end of the smallest interfitting telescoping section for engaging and gripping the largest interfitting telescoping section when collapsed one within the other. For this purpose, the cane tip preferably has a resiliently expandable collar portion for releasable engagement and disengagement relative to one end of the largest interfitting telescoping section. The largest interfitting telescoping section at its non-engaged end includes a knob for gripping thereof by the user, the knob including at least one flat section to keep the cane from rolling. An alternate equivalent construction includes a knob having an exterior polygonal configuration having a plurality of flat sections to keep the cane from rolling.

Other and further objects and advantages of the present invention will become apparent from the ensuing description.

BRIEF DESCRIPTION OF THE DRAWINGS

In the drawings,

FIG. 1 is a perspective view of the improved collapsible cane constructed in accordance with the teachings of the present invention, with the cane shown in collapsed compact storage thereof;

FIG. 2 is perspective view of the collapsible cane of the present invention, with the interfitting telescoping sections being extended for use in walking;

FIG. 3 is an enlarged fragmentary side elevational view, partly in section, of one of the internal locking elements used between adjacent interfitting telescoping sections;

FIG. 4 is an exploded side elevational view of the internal locking element shown in FIG. 3 of the drawing, with each component separated from the other components;

FIG. 5 is an enlarged fragmentary side elevational view of the end knob of the collapsible cane showing one type of construction to prevent the cane from rolling;

FIG. 6 is an exploded fragmentary side elevational view, partially in section, generally in full size representation, and illustrating the various components incorporated in the collapsible cane of the present invention;

FIG. 7 is a fragmentary side elevational view, partially in section, also being a full size representation, of the internal expansion assembly which interlocks the adjacent largest interfitting telescoping sections relative to one another;

FIG. 8 is also a fragmentary side elevation view, partially in section, illustrating a full size representation of different adjacent interfitting telescoping sections which are interlocked relative to one another by an internal expansion assembly; and FIG. 9 is a further side elevational view, partially in section, illustrating in full size representation yet another internal expansion assembly for interlocking the smallest telescoping interfitting sections of the collapsible cane of the present invention.

Corresponding reference numerals will be used throughout the various figures of the drawings.

DESCRIPTION OF THE PREFERRED EMBODIMENT

The following detailed description illustrates the principles of the invention by way of examples, and not by way of limitation. This description will clearly enable one skilled in the art to make and use the invention, and describe several embodiments, adaptions, variations, alternatives and uses of the invention, including what we presently believe is the best mode of carrying out the invention.

The prior related co-pending application is herein incorporated by reference for background information purposes since the present invention is an improvement over several of the features of the "COLLAPSIBLE CANE" disclosed in the prior relate co-pending application. In order to understand the specific improvements of the present invention, the operating components and principles of operation of the "COLLAPSIBLE CANE" in the prior related co-pending application will be briefly discussed.

Collapsible cane 1 shown in FIG. 1-2 of the drawings includes a series of interfitting smaller and larger telescoping sections which are interlocked against collapse when extended, and are also interlocked together when collapsed. Specifically, the interfitting telescoping sections 3, 5, 7 and 9 of the collapsible cane 1 comprise a series of progressively smaller telescoping sections enabling telescoping assembly of adjacent telescoping sections relative to one another, and with telescoping sections 5, 7 and 9 being captured within the largest telescoping section 3 when all of the interfitting telescoping sections 3, 5, 7 and 9 are longitudinally collapsed relative to one another, as shown in FIG. 1 of the drawings. Preferably, each of the interfitting telescoping sections 3, 5, 7 and 9 are formed as cylindrical tubes from annodized aluminum, thereby providing a lightweight durable and non-corrosive construction.

In order to prevent electrical shock from the aluminum cylindrical tubes 3, 5, 7 and 9, an insulated plastic top or knob 11 is connected to the open upper end of the largest interfitting telescoping section 3, an insulated plastic cane tip 13 is secured to the outer free end of the smallest interfitting telescoping section 9, and an elongated circumferentially extending band 15 of insulating material surrounds the largest interfitting telescoping adjacent the closure top or knob 11. Thus, a user of the collapsible cane 1 may grip the insulated material top or knob 11 and the insulating material band 15 when using the collapsible cane 1. The insulated material cane tip 13 also functions in similar manner to prevent electrical shock from objects touched by cane tip 13. Preferably, both the closure top or knob 11 and the cane tip 13 are made from a plastic material such as "Nylon" to provide the lightweight, durable, yet insulating features desired. The elongated circumferentially extending band or safety grip 15 is preferably formed from a flexible self-conforming insulating material such as an elongated rubber tube or the like.

The closure top or knob 11 is shown in FIGS. 5–6 of the drawings as being secured to the open upper end of the largest interfitting telescoping section 3 by a roll pin 17 that extends through aligned openings (not shown) in the largest interfitting telescoping section 3 for reception within a complementary shaped opening 19 in a smaller circumferential portion 21 of the knob 11 that is received within the open upper end of the largest interfitting telescoping section 3. The passageway 19 is positioned for register with the aligned openings (not shown) in the largest interfitting telescoping section 3 for receipt of the roll pin 17. This securely locks the closure top or knob 11 relative to the largest interfitting telescoping section 3 of the collapsible cane 1.

As best seen in FIG. 5 of the drawings, the closure top or knob 11 includes a flat section 23 in order to keep the collapsible cane 1 from rolling, when placed on a surface. The knob 11 may have a variety of different shapes to accomplish this, such as an exterior polygonal configuration including a plurality of flat sections, however, it being only necessary that the knob 11 include at least one flat section 23 to keep the cane from rolling.

In order to keep the series of interfitting telescoping section 3, 5, 7 and 9 interlocked together when collapsed, the inner end 4 the largest interfitting telescoping section 3 is constructed to releasably engage a cane tip 13. As seen in FIG. 6 of the drawings, the cane tip 13 has an internally threaded bore 25 for cooperative threaded mating engagement with the threads 27 at the free end of the smallest interfitting telescoping section 9. The body of the cane tip 13 further has a transversely extending threaded opening 29 for receiving a set screw 31 for engaging the threads 27 of the smallest interfitting telescoping section 9, in order to securely retain the cane tip 13 to the outermost end of the smallest telescoping section 9. Cane tip 13 is provided with a resiliently expandable collar portion 33 which includes a series of circumferentially extending and resiliently expandable fingers 35 for resilient and external gripping engagement with the inner end 4 of the largest interfitting telescoping section 3 of the collapsible cane 1. Thus, when all of the telescoping interfitting sections 3, 5, 7 and 9 are collapsed as shown in FIG. 1 of the drawings, the inner end 4 of the largest interfitting telescoping section 3 is positioned to be releasably gripped and engaged by the resiliently deflectable fingers 35 of the resiliently expandable collar portion 33 for externally interlocking the interfitting telescoping sections together as a unit.

In order to provide a walking cane, adjacent interfitting smaller and larger telescoping sections are interlocked against collapse when extended. In general, this is accomplished by providing each smaller interfitting telescoping section with internal expansion means which is activated by relative rotary movement between adjacent larger and smaller adjacent interfitting telescoping sections for engagement with an inner wall of the larger interfitting telescoping section. As a result, internal expansion means expands against the inner wall and interlocks adjacent interfitting telescoping sections against collapse, for using the collapsible cane 1 as a walking cane.

While the components of the present invention for interlocking adjacent interfitting telescoping sections to one another are similar to the operative components disclosed in the prior related co-pending application, it will be seen that there are substantial improvements that provide guiding and centering of adjacent interfitting telescoping sections when extended or collapsed, an improved positive locking of the operative components, a safety feature in the event of failure of one of the operative components, a better and more economical way in which to assemble the components and the interfitting telescoping sections, and further other features and advantages which will become apparent from the discussion that follows.

Reference is now made to FIGS. 3–4 and 6–9 of the drawings for a description of the operative components which are used to interlock adjacent interfitting telescoping sections 3, 5, 7 and 9 against collapse when extended, in order to allow the collapsible cane 1 to function as a strong and durable supporting walking cane structure. As best seen in FIGS. 3–4 of the drawings, the new and improved internal expansion means is generally identified by reference character 37. Each of the smaller interfitting telescoping section in the adjacent interfitting telescoping sections of the collapsible cane 1 include the internal expansion means or elements 37, differing only in general size and shape of such components for reception within progressively smaller interfitting telescoping sections. This is best illustrated in FIG. 6 of the drawings where there are three internal expansion means or elements 37 adapted to be carried by the interfitting telescoping sections 5, 7 and 9. In order to distinguish from each other, while at the same time indicating that the internal locking means or elements 37 function relative to their associated interfitting telescoping section in the same manner, reference character 37 will be used in each instance, with the suffix "a", "b", and "c" used to distinguish between different sized and shaped internal locking means or elements 37. Thus, as shown in FIG. 6 of the drawings, the internal locking means **37*a* is shown as being mounted to the upper end of the interfitting telescoping section 5, the internal locking means 37*b* is mounted to the upper end of the interfitting telescoping section 7, and the internal locking means 37*c* is connected to the upper end of the smallest interfitting telescoping section 9. Since the function and operation of the internal expansion means 37*a*, 37*b* and 37*c* are generally the same, it will be necessary to only describe the operation of one of the internal expansion means, in order to understand the operation of the others. Therefore, attention is principally directed to the internal expansion means 37*a* mounted or secured to the open upper end of the interfitting telescoping section 7, and the manner in which same operates with respect to the associated adjacent interfitting telescoping section 5**.

Each larger interfitting telescoping section includes a circumferential depression or groove 39 against which the internal expansion means 37 operates to expand against an internal wall of the larger interfitting telescoping section upon relative rotary movement between the sections. The circumferential depression or groove 39 is the same in each of the larger interfitting telescoping section, and therefore, reference character 39 will be used in each instance, with the suffix "a", "b", and "c" utilized to distinguish between the various larger interfitting sections. Thus, the lower end of the largest interfitting telescoping section 3 is provided with a circumferential depression or groove 39*a*, the lower end of the interfitting tubular section 5 is provided with a circumferential depression or groove 39*b*, and the lower end of the interfitting telescoping section 7 is provided with a circumferential depression or groove 39*c*. In addition, at least one and perhaps several or all of the larger telescoping sections also include a second circumferential depression or groove 41 immediately positioned adjacent an outer free end of each of the larger telescoping sections. As shown in FIG. 6 of the drawing, the second circumferential depression or groove 41 is identified with the same corresponding suffixes as 41*a* follows: circumferential depression or groove in the largest interfitting telescoping section 3 immediately adjacent the outer free end thereof, a second circumferential depression or groove 41*b* in the interfitting telescoping section 5 immediately adjacent an outer free end thereof, and a second circumferential depression or groove 41*c* immediately adjacent an outer free end thereof, the function of which will become apparent in the ensuing discussion.

Reference is now specifically made to FIGS. 3–4 for a description of the various components that makeup the internal expansion means 37. As illustrated in these figures, an elongated common threaded member 43 is provided with an enlarged head 45 at one end thereof. The enlarged head 45 is preferably slotted or otherwise formed with driver engaging surfaces to facilitate assembly of the common threaded member 43 to the complementary threaded first and second wedge elements 47 and 49. The spaced first and second wedge elements 47, 49 are adapted to be threadably engaged relative to the common threaded member 43 with the non-threaded locking cylinder 51 mounted therebetween, as shown in FIG. 3 of the drawings. Each of the first and second wedge elements 47, 49 are preferably made from a lightweight aluminum material, while the locking cylinder 51 is made from a durable yet flexible material such as "Nylon" to enable the locking cylinder to expand as it is opened about the longitudinally extending slot 53. For this purpose, the first wedge element 47 has a tapered or wedge surface 55 for engaging one end 57 of the locking cylinder 51, while the second wedge element 49 has a wedge or tapered surface 59 for engaging the second or opposite end 61 of the locking cylinder 51, as best seen in FIG. 3 of the drawings.

As illustrated in FIG. 6 of the drawings, each of the internal expansion means 37*a*, 37*b*, and 37*c* are adapted to be mounted and secured relative to the interfitting telescoping sections 5, 7 and 9, respectively. For this purpose, the internal expansion means 37 further includes a roll pin 63 or the like for receipt within a complementary opening 65 of the second wedge element 49 for pinning the second wedge element 49 and common threaded member 43 to each other, while also pinning the entire internal expansion means 37 to a respective interfitting telescoping section. Thus, as shown in FIG. 6 of the drawings, the roll pin 61*b*, for example, extends through the interfitting telescoping section 7, as well as the second wedge element 49 and the common threaded member 43, for securing the internal expansion means 37*b* in a fixed and non-rotating position relative to the interfitting telescoping section 7. Each of the internal expansion means 37*a* and 37*c* are secured to their respective interfitting telescoping sections 5 and 9 in the same manner.

Referring now to FIG. 3 of the drawings, when the internal expansion means is assembled with the immediate locking cylinder 51 positioned between the first and second properly engaged wedge elements 47 and 49, the enlarged head 45 will engage the transverse end surface 67 of the wedge element 47, while the wedge surfaces 55 and 59 of the first and second wedge elements 47, 49 respectively will engage opposite ends 57, 61 of the locking cylinder 51 in a relatively free and non-expanded condition. This relatively same position is shown in each of the internal locking means 37*a*, 37*b* and 37*c*, in FIG. 6 of the drawings, when they are mounted and secured by the roll pin 63*a*, 63*b* and 63*c* to their respective associated interfitting telescoping section 5, 7 and 9 respectively. This enables the internal expansion means 37 mounted to each of the respective fitting telescoping sections to be assembled relative to an adjacent larger interfitting telescoping section. Thus, with the internal expansion means 37*a* secured to the interfitting telescoping section 5, the largest interfitting telescoping section 3 may be slidably mounted thereover for assembly of the adjacent interfitting section 3, 5 relative to one another. This is preferably accomplished by first positioning the end of the section 3, not having the circumferential depressions or grooves 39*a*, 41*a*, over the end of the section 5 not having the internal expansion means 37*a*, and then telescopically assembling the section 3 and 5 together to bring the internal expansion means 37*a* in proximity to the first and second circumferential depression or grooves 39*a*, 41*a*.

As best seen in FIG. 7 of the drawings, the internal dimension of the first circumferential depression or groove 39*a* is constricted sufficiently for engaging the wedge surface 55*a* of the first wedge element 47*a*. As has been previously explained, the internal expansion means 37*a* operates against the first circumferential depression or groove 39*a*, and in this specific respect, the wedge surface 55*a* is arranged for interfering engagement relative to the respective circumferential depression or groove 39*a* of the largest interfitting telescoping section 3. As a result, when the interfitting telescoping sections 3 and 5 are extended relative to one another, wedge element 47*a* is thus restricted from moving beyond the circumferential depression or groove 39*a*. At the same time, this allows rotation of the interfitting telescoping section 5 relative to the interfitting telescoping section 3, causing the wedge elements 47*a* and 49*a* to axially contact the locking cylinder 51*a*, through engagement of the wedge surfaces 55*a* and 59*a* contacting the opposite ends 57*a* and 61*a*, respectively, of the locking cylinder. This causes radial expansion of the locking cylinder 61 along the elongated longitudinal slot 53*a*, thereby causing radial expansion of the locking cylinder 51 against the inner wall of the interfitting telescoping section 3.

Only a few turns of rotation of the interfitting telescoping section 5 relative to the interfitting telescoping section 3 is all that is required to cause internal expansion of the locking cylinder 51*a* against the inner wall of the interfitting telescoping section 3, to provide the internal frictional gripping and contact of the locking cylinder 51*a* along the entire length thereof relative to the inner wall of the interfitting telescoping section 3. This prevent axial collapse of the interfitting telescoping sections 3 and 5 relative to one another, even under sufficient axial force as would come by supporting the body of a handicapped person during use of the extended collapsible cane 1, during walking. It will be noted that in the extension and collapse of the adjacent interfitting telescoping sections 3, 5, the shape, dimension and configuration of the first wedge element 47*a* is such that the longitudinal circumferential portion 69*a* slidably engages the inner wall of the largest interfitting telescoping section, when the internal expansion means 37*a* is in non-expanded position. To further facilitate the centering and guiding action of the adjacent interfitting telescoping sections 3, 5, during extension and collapse thereof, and particularly in providing the proper position and alignment of the various components of the internal expansion means 37*a* relative to the section 3, 5, the second circumferential depression or groove 41*a*, longitudinally spaced from the first circumferential depression or groove 39*a*, is constricted sufficiently to provide slidable engagement with an outer wall of the adjacent interfitting telescoping section 5. Thus, the longitudinal or circumferential portion 69*a* of the wedge element 47*a* will provide slidable engagement with the inner wall of the largest interfitting telescoping section 3, while the second circumferential depression or groove 41*a* provides slidable engagement with outer wall of the adjacent interfitting telescoping section 5 in spaced guiding and centering action relative to one another, and for also proper positioning and alignment of the various components of the internal expansion means 37*a* relative to the section 3, 5.

In addition, and as the result of wear and tear of the various components of the internal expansion means 37*a* during continued and long use thereof, in the event of non-functioning of the first circumferential depression or groove 39*a*, there will be slight relative extension between the section 3, 5 until the end 61*a* of the locking cylinder 51*a* engages the second circumferential depression or groove 41*a*. This provides a safety feature in the event the first circumferential depression or groove 39*a* becomes inoperative due to wear, thus enabling the second circumferential depression or groove 41*a* to engage the end 61*a* of the locking cylinder 51 and prevent collapse of the sections 3 and 5.

As specifically shown in FIG. 1 of the drawings, it may be only necessary to provide the second circumferential depression or groove 41*a* in the largest interfitting telescoping section 3, in certain embodiments and forms of the invention. Thus, while each of the interfitting telescoping sections 5 and 7 are shown in FIG. 2 of the drawings as including both first and second spaced circumferential depression or grooves 39*b*, 41*b* and 39*c*, 41*c* respectively, the largest interfitting scoping section 3 is provided with only the second circumferential depression or groove 41*a*, and the smallest telescoping section 9 is provided with no grooves whatsoever. As will be appreciated, depending on the length of the various interfitting sections 3, 5, 7 and 9 and the desired operation thereof, some of the interfitting telescoping sections may have no circumferential depressions or grooves (such as the smallest interfitting section 9), some of the interfitting sections may have only the second circumferential depression or groove (such as the largest interfitting telescoping section 3), and at least one or more interfitting sections may have both the first and second circumferential depression or grooves (such as the interfitting sections 5 and 7).

In addition to the aforesaid guiding and centering action, and safety features, improved expansion means 37 provides a positive locking action, as a result of the rotary interlocking movement between adjacent interfitting telescoping sections. Note that the enlarged head 45*a* engages the transverse end surface 67*a* of the wedge element 47*a* while the roll pin 63 secures the wedge element 49*a* and common threaded member 43*a* to the section 5. Following the centering and alignment of the components of the internal expansion means 37*a* relative to the extended adjacent interfitting sections 3, 5, simple rotary movement of the section 5 relative to the section 3 causes the wedge elements 47*a*, 49*a* to move relatively toward one another along the common threaded member 43*a* until wedge surface 47*a* engages the circumferential depression or groove 39*a* restricting further axial movement. The resulting expansion of the locking cylinder 51*a* will securely and positively lock the adjacent interfitting telescoping sections 3, 5 relative in to one another relatively, in hand-tight coupling relationship.

As has been previously explained, each of the internal locking means 37*b* and 37*c* will operate with respect to the interfitting telescoping sections 5, 7 and 7, 9 respectively in the same manner as the internal expansion means 37 functions with respect to the interfitting telescoping sections 3, 5. Thus, further detailed explanation of same is unnecessary.

From the foregoing, it will now be appreciated that the collapsible cane 1 of the present invention has a series of interfitting smaller and larger telescoping sections which are interlocked against collapse when extended. Smaller interfitting telescoping sections carry internal expansion means within are adapted for engagement with a inner wall of an adjacent larger interfitting telescoping section upon relative rotary movement between the adjacent sections. Internal expansion means operates against a circumferential depression or groove formed in the larger interfitting telescoping section, enabling the internal expansion means to expand against the internal wall of the larger interfitting telescoping section. At least one of the larger telescoping sections may also include a second circumferential depression or groove which is longitudinally space from the first circumferential depression or groove and is immediately positioned adjacent an outer free end of each larger telescoping section. As explained in detail above, each second circumferential depression or groove slidably engages an outer wall of an adjacent smaller telescoping section in providing guiding and centering for the adjacent interfitting smaller and larger telescoping sections, during and extension and collapse thereof. In the event the first circumferential depression or groove wears down as a result of continued use, the second circumferential depression or groove, after slight axial shift, will maintain the prior interlocking relationship between components. The above described new and improved construction further provides a positive locking action between adjacent interfitting telescoping section. Finally, various interfitting telescoping sections and internal expansion means may be quickly and easily assembled to one another, while also providing all of the features and advantages described above.

In view of the above it will be seen that several objects of the invention are achieved and other advantageous results are obtained.

As various changes could be made in the above construction without departing from the scope of the invention, it is intended that all matter contained in the above description or shown in the accompanying drawings shall be interpreted as illustrative and not in a limiting sense.

We claim:

1. A collapsible cane having a series of innerfitting smaller and larger telescoping sections which are interlocked against collapse when extended, each said smaller innerfitting telescoping section carrying internal expansion means activated by relative rotary movement between adjacent larger and smaller innerfitting telescoping sections for engagement with an inner wall of said larger innerfitting telescoping section, said internal expansion means including wedge elements threadably engaged by a common threaded member on opposite sides of a longitudinally slit locking cylinder to provide radial expansion and engagement with the inner wall of said larger innerfitting telescoping section, each said larger innerfitting telescoping section including circumferential depression means against which said internal expansion means operates to expand against an internal wall of said larger innerfitting telescoping section during the relative rotary movement between said sections, at least one of said larger telescoping sections also including a second circumferential depression means longitudinally spaced from said first circumferential depression means and positioned immediately adjacent an outer free end of each said larger telescoping sections, and each said second circumferential depression means in at least one of said larger telescoping sections being slidably engaged by an outer wall of an adjacent smaller telescoping innerfitting section to provide guiding and centering for said adjacent innerfitting smaller and larger telescoping sections during extension and collapse thereof.

2. The collapsible cane as defined in claim 1 wherein each said second circumferential depression means is also positioned for engaging said internal expansion means to maintain operative engagement with the internal wall of said larger interfitting telescoping section, in the event of failure of said first circumferential depression means worn down by continued use thereof.

3. The collapsible cane as defined in claim 2 wherein said interfitting telescoping sections comprise a series of progressively smaller telescoping sections enabling relative telescoping assembly of adjacent telescoping sections within each other and all of said telescoping sections being captured within the largest telescoping section when all of said interfitting telescoping sections are longitudinally collapsed relative to one another.

4. The collapsible cane as defined in claim 3 wherein all but the largest and smallest of said interfitting telescoping sections include both said longitudinally spaced circumferential depression means.

5. The collapsible cane as defined in claim 3 wherein each said internal expansion means and said at least one circumferential depression means are each provided adjacent one end of said interfitting telescoping sections for engagement thereby when extended.

6. The collapsible cane as defined in claim 5 wherein each said internal expansion means of each smaller innerfitting telescoping section includes wedge elements having opposed wedge surfaces for engaging and expanding said associated intermediate longitudinally slit locking cylinder against an internal wall of an adjacent larger innerfitting telescoping section.

7. The collapsible cane as defined in claim 6 wherein said common threaded member is provided with an enlarged head for engaging a transverse end surface of one of said wedge elements, and the other wedge element being pinned to said common threaded member and to said smaller innerfitting telescoping section.

8. The collapsible cane as defined in claim 7 and including external gripping means for gripping the largest interfitting telescoping sections when all of said interfitting telescoping sections are telescoped therein and interlocking said interfitting telescopy sections together as a unit.

9. The collapsible cane as defined in claim 8 wherein said external gripping means comprises a cane tip mounted at an outermost free end of the smallest interfitting telescoping section for engaging and gripping the largest interfitting telescoping section when collapsed one within the other.

10. The collapsible cane as defined in claim 9 wherein said cane tip includes a resiliently expandable collar portion for releasable engagement and disengagement relative to one end of the largest interfitting telescoping section.

11. The collapsible cane as defined in claim 10 wherein the largest interfitting telescoping section at its non-engaged end includes a knob for gripping thereof by a user, said knob including at least one flat section to keep said cane from rolling.

12. The collapsible cane as defined in claim 11 wherein said knob has an exterior polygonal configuration including a plurality of flat sections.

13. The collapsible cane as defined in claim 1 wherein said first and second circumferential depression means each comprise a circumferentially continuous groove of uniform cross section throughout.

14. A collapsible cane having a series of interfitting smaller and larger telescoping sections which are interlocked against collapse when extended, each said smaller interfitting telescoping section carrying internal expansion means activated by relative rotary movement between adjacent larger and smaller interfitting telescoping sections for engagement with an inner wall of said larger interfitting telescoping section, each said larger interfitting telescoping section including circumferential depression means against which said internal expansion means operates to expand against an internal wall of said larger telescoping section during the relative rotary movement between said sections, each said internal expansion means including wedge elements threadably engaged by a common threaded member on opposite sides of an intermediate locking cylinder which also extends about said common threaded member, said common threaded member having an enlarged head for engaging a transverse end surface of one of said wedge elements which extends within an adjacent larger interfitting telescoping section while said wedge element is positioned to engage aid circumferential depression means, the other of said wedge elements being pinned to said common threaded member and to its associated smaller interfitting telescoping section with said locking cylinder in substantially non-expanded position therebetween, said wedge element pinned to its associated smaller interfitting telescoping section being moved toward said other wedge element within said larger interfitting telescoping section upon relative rotary movement of said adjacent interfitting smaller and larger interfitting tubular sections to cause said locking cylinder to be expanded against the inner wall of said larger interfitting telescoping section, and said enlarged head of the common threaded member engaging the transverse end surface of said wedge element within the adjacent larger interfitting telescoping section while said wedge element engages both said circumferential depression means in said larger interfitting telescoping section and said locking cylinder, for positive engagement and locking of adjacent smaller and larger interfitting telescoping sections.

15. The collapsible cane as defined in claim 14 wherein at least several of said larger interfitting telescoping sections also including a second circumferential depression means being longitudinally spaced from said first circumferential depression means and immediately positioned adjacent an outer end of each said larger interfitting telescoping section, and each said second circumferential depression means longitudinally spaced from said first circumferential depression means and immediately positioned adjacent an outer end of each said larger interfitting telescoping section, and each said second circumferential depression means in said larger interfitting telescoping sections being slidably engaged by an outer wall of an adjacent smaller telescoping interfitting section to provide guiding and centering action therebetween during extension and collapse thereof.

16. The collapsible cane as defined in claim 15 wherein each said second circumferential depression means is also positioned for engaging said locking cylinder to maintain operative engagement with the internal wall of said larger interfitting telescoping section, in the event of failure of said first circumferential depression means worn down by continued use thereof.

17. The collapsible cane as defined in claim 16 wherein said first and second circumferential depression means comprise a circumferentially continuous groove of uniform section throughout.

* * * * *